US008360028B2

(12) United States Patent
Betzmeir et al.

(10) Patent No.: US 8,360,028 B2
(45) Date of Patent: Jan. 29, 2013

(54) PISTON WITH TWO PIVOT BEARINGS AND TWIN CRANKSHAFT PISTON ENGINE

(75) Inventors: Helmut Betzmeir, Ottobrunn (DE); John David Kirk, Fond du Lac, WI (US)

(73) Assignee: Neander Motors, Kiel (DE)

( * ) Notice: Subject to any disclaimer, the term of this patent is extended or adjusted under 35 U.S.C. 154(b) by 248 days.

(21) Appl. No.: 12/807,413

(22) Filed: Sep. 4, 2010

(65) Prior Publication Data

US 2012/0055443 A1 Mar. 8, 2012

(51) Int. Cl.
*F02B 75/32* (2006.01)

(52) U.S. Cl. ..... 123/197.4; 123/197.1; 123/196 R; 123/53.2

(58) Field of Classification Search ..... 123/197.1, 123/197.2, 197.4, 197.3, 196 R, 53.2
See application file for complete search history.

(56) References Cited

U.S. PATENT DOCUMENTS

| | | | | |
|---|---|---|---|---|
| 3,369,733 | A * | 2/1968 | Campbell | 417/341 |
| 4,301,695 | A * | 11/1981 | Reiher | 74/602 |
| 4,346,677 | A * | 8/1982 | Nye | 123/53.1 |
| 6,295,962 | B1 * | 10/2001 | Walker | 123/192.2 |
| 7,240,647 | B2 * | 7/2007 | Betzmeir | 123/53.2 |
| 7,406,930 | B2 * | 8/2008 | Banke | 123/48 B |
| 7,584,724 | B2 * | 9/2009 | Berger | 123/48 R |
| 2007/0079788 | A1 * | 4/2007 | Betzmeir | 123/196 R |
| 2010/0077984 | A1 * | 4/2010 | Baindl et al. | 123/197.4 |

* cited by examiner

*Primary Examiner* — Noah Kamen
*Assistant Examiner* — Long T Tran
(74) *Attorney, Agent, or Firm* — Von Rohrscheidt Patents

(57) ABSTRACT

A piston for a piston-cylinder unit, the piston including two pivot bearings for pivotably supporting two connecting rods at the piston about two connecting rod pivot two connecting rod pivot axes extending in parallel to one another and laterally offset from one another; the two pivot bearings provided at a bearing element which is pivotably supported about a bearing element pivot axis at the piston; and the bearing element pivot axis extending parallel to the two connecting rod pivot axes.

21 Claims, 5 Drawing Sheets

PISTON WITH TWO PIVOT BEARINGS AND TWIN CRANKSHAFT PISTON ENGINE

FIELD OF THE INVENTION

The present invention relates to a piston, in particular for a piston-cylinder unit with two pivot bearings for pivotably supporting a respective connecting rod at a piston. The invention furthermore relates to a twin crankshaft piston engine.

There are problems when synchronizing two rotating crankshafts of twin crankshaft piston engines with one another. Thus, each of the crankshafts is provided e.g. with a synchronization gear, wherein the synchronization gears mesh with one another. Thermal influences during operation of the twin crankshaft piston engine or also wear at the tooth flanks of the synchronization gears can cause a clearance between the teeth of the synchronization gears meshing with one another which in turn causes minor asymmetry of the rotation of the crankshafts which can cause undesirable tilting of the piston in the cylinder. For a rotational asymmetry of this type of the crankshafts, the crankshafts and the entire crankshaft drive associated therewith still counter rotate in time based synchronization, but one of the crankshafts precedes the rotation of the other crankshaft, so that the connecting rod bearing axes on the crankshaft side do not reach their top dead centers exactly at the same time, but subsequent to one another. This in turn has the consequence that also the connecting rod bearings on the piston side reach their top dead centers with sequential timing which leads to a tilt movement in the piston. The precession of one of the crankshafts over the other crankshaft certainly applies for the entire rotation of the crankshafts which are synchronized and thus rotate at the same speed, which is designated as "asymmetry of crankshaft rotation" in the present application. As stated supra, this asymmetry imparts a tilt moment upon the piston to a first side in the top dead center of the piston and imparts a respective second tilt moment upon the piston to a second side in the lower dead center. Thus, the piston performs a tilt movement to a first side and to a second side during its upward and downward motion, wherein the tilt movement reverses in the respective dead centers and is performed in a plane which is orthogonal to the crankshaft axes.

BACKGROUND OF THE INVENTION

In order to solve the problem it is proposed in U.S. 2010/0077984 A1 to support both crankshafts in a joint support block in order to eliminate the clearance between the tooth flanks and to select the material for the support block and the material for the crankshafts and the material for the synchronization gears with respect to its thermal expansion coefficient, so that the thermal expansion of the support block between the two rotation axes of the crankshafts is substantially identical with the thermal expansion of the synchronization gears. This however causes a configuration with substantial complexity.

An adjustable support block for a twin crankshaft piston engine is known from DE 10 2006 060 660 A1, wherein the offset between the axes of the crankshafts is configured adjustable, so that an undesirable support clearance and tooth flank clearance can be eliminated in this manner. Also this solution is rather complex with respect to its technical implementation.

It is known from DE 10 2006 036 827 A1 to provide a piston with a convex external contour for a twin crankshaft piston engine. The piston tolerates a minor tilting of the longitudinal piston axis relative to the longitudinal cylinder axis caused by an asymmetry of the rotation of the crankshafts without causing a binding of the piston in the cylinder or increased friction.

BRIEF SUMMARY OF THE INVENTION

Thus, it is an object of the invention to provide a piston of this type which is configured for a twin crankshaft piston engine and which is tolerant with respect to an asymmetric movement of the piston drive caused by wear. It is another object of the invention to provide a twin crankshaft piston engine which is tolerant with respect to a slightly asymmetric rotation of the crankshafts caused by wear.

Another object with respect to the piston is achieved by a piston for a piston-cylinder unit including two pivot bearings for pivotably supporting two connecting rods at the piston about two connecting rod pivot axes; the two connecting rod pivot axes extending in parallel to one another and laterally offset from one another; the two pivot bearings provided at a bearing element which is pivotably supported about a bearing element pivot axis at the piston; and the bearing element pivot axis extending parallel to the two connecting rod pivot axes.

The piston which is provided with two pivot bearings for pivotably supporting a respective connecting rod about a respective connecting rod pivot axis, wherein the two rod pivot axes extend parallel to one another and laterally offset from one another, includes pivot bearings provided at a bearing element which is provided at the piston so that the bearing element is pivotably supported about a bearing pivot axis which extends parallel to the connecting rod pivot axes.

This bearing element which is additionally provided according to the invention over the prior art can rotate relative to the piston for an uneven movement of the piston connecting rods, thus for an asymmetric rotation of the crankshafts and thus compensates the asymmetry of rotation of the two crankshafts without the piston being tilted with its longitudinal piston axis relative to the longitudinal cylinder axis.

Advantageously, the bearing pivot axis is disposed equidistant from the connecting rod pivot axes viewed in a pivot plane disposed orthogonal to the bearing pivot axis. This symmetrical configuration provides a balanced force flow.

The bearing pivot axis is advantageously disposed in the center of a straight line connecting the connecting rod pivot axes in the pivot plane. Also this embodiment provides advantageous kinematic conditions.

An advantageous embodiment of the piston according to the invention is characterized in that the support element includes a circular contour or two preferably symmetrically disposed circular segment shaped contours, whose circle center is disposed on the bearing pivot axis, so that the piston is provided with an accordingly adjusted circular contour or with adjusted circular segment shaped contours whose circle center is also disposed on the bearing pivot axis and in that the circular segment shaped contours of the bearing element and the circular or circular segment shaped contours of the piston are disposed, so that they contact one another but are moveable relative to one another about the common bearing pivot axis. This circular or circular segment shaped configuration of the bearing element can be integrated into the piston in a particularly simple manner.

The bearing element can thus be configured as a disc or as a ring and the circular contour or the circular segment shaped contours are configured at an outer circumference of the bearing element.

Alternatively the bearing element can be configured as a ring and the circular contour or the circular segment shaped contours can be configured at an inner circumferential edge of the bearing element.

Another object of the invention relates to the twin crankshaft piston engine is achieved through a twin crankshaft piston engine with at least one piston cylinder unit including a cylinder in which a reciprocating piston is disposed, so that it can move back and forth; a first crankshaft; and a second crankshaft. The first crankshaft and the second crankshaft extend parallel to one another and rotate synchronously in opposite directions. The rotation axes of the two crankshafts extend parallel to a common cylinder center plane and are laterally offset with respect to the cylinder center plane. A first and a second connecting rod is associated with the reciprocating piston, so that the first connecting rod is pivotably supported with its first end at the reciprocating piston in a first pivot bearing about a first connecting rod pivot axis and rotatably supported with its second end at a crank pin of the first crankshaft; and the second connecting rod is pivotably supported with its first end at the reciprocating piston in a second pivot bearing about a second connecting rod pivot axis and rotatably supported with its second end at a crank pin of the second crankshaft. The first and the second pivot bearing are provided at a bearing element which is pivotably supported at the piston about a bearing element pivot axis which extends parallel to the connecting rod pivot axes.

This twin crankshaft piston engine which includes at least one piston-cylinder unit is provided with a cylinder in which a reciprocating piston is moveably disposed, a first crankshaft, a second crankshaft, wherein the first crankshaft and the second crankshaft extend parallel to one another and rotate synchronously with one another in opposite directions, wherein the rotation axes of the two crankshafts extend parallel to a common cylinder center plane and are offset in lateral direction with respect to the center plane, wherein the reciprocating piston is associated with a first connecting rod and a second connecting rod, so that the first connecting rod is pivotably supported with its first end in a first pivot bearing and rotatably supported with its second end at a crank pin of the first crankshaft and wherein the second connecting rod is pivotably supported at the reciprocating piston with its first end in a second pivot bearing and rotatably supported with its second end at a crank pin of the second crankshaft. The twin crankshaft piston engine according to the invention is characterized in that the pivot bearings are provided at a bearing element which is pivotably supported at the piston about a bearing pivot axis which extends parallel to the connecting rod pivot axes.

Advantageously the bearing pivot axis is offset in an equidistant manner from the connecting rod pivot axes in a pivot plane that is orthogonal to the bearing pivot axis.

It is additionally preferred that the bearing pivot axis is disposed in the center of a straight line connecting the connecting rod pivot axes with one another in the pivot plane.

An advantageous embodiment of the twin crankshaft piston engine is characterized in that the bearing element comprises a circular contour or two circular segment shaped contours, whose circle center is disposed on the bearing pivot axis, so that the piston is provided with a circular contour or with circular segment shaped contours, whose circle center is also disposed on the bearing pivot axis and in that the circular or circular shaped contours of the bearing element and the circular or circular segment shaped contours of the piston are disposed, so that they touch one another while being moveable relative to one another about the common bearing pivot axis.

Thus, the bearing element is advantageously configured as a disc or as a ring and the circular segment shaped contour or the circular segment shaped contours are configured at an outer circumference of the bearing element.

Alternatively the bearing element can be configured as a ring and the circular segment shaped contour or the circular segment shaped contours can be configured at an inner circumferential edge of the bearing element.

It is furthermore advantageous when the assembly made from the two crankshafts running in opposite directions in a synchronous manner is configured, so that the crank pins rotate in opposite directions, but in a slightly asymmetric manner. This asymmetric rotation means that the crank pin of the one crankshaft slightly precedes the crank pin of the other crankshaft, thus e.g. reaches its upper dead center and its lower dead center slightly earlier than the other crank pin. This intentionally provided asymmetry provides that in an ideal case in which there is no wear in the synchronization gears, a minor relative rotation of the bearing element is performed relative to the piston in order to prevent that the support of the bearing element in the piston is deformed by a permanent static load.

Thus it is advantageous when the asymmetry of the rotation of the crank pins is 5° at the most, more advantageously between 1° and 3°, and additionally more advantageously 2°.

It is also advantageous when the asymmetry of the rotation of the crank pins is based on an offset of 1 to 6 teeth between meshing gears respectively disposed on the first crankshaft and on the second crankshaft.

BRIEF DESCRIPTION OF THE DRAWINGS

The invention is subsequently described based on an exemplary embodiment with reference to the drawing figures, wherein.

DETAILED DESCRIPTION OF THE INVENTION

Figure 1:
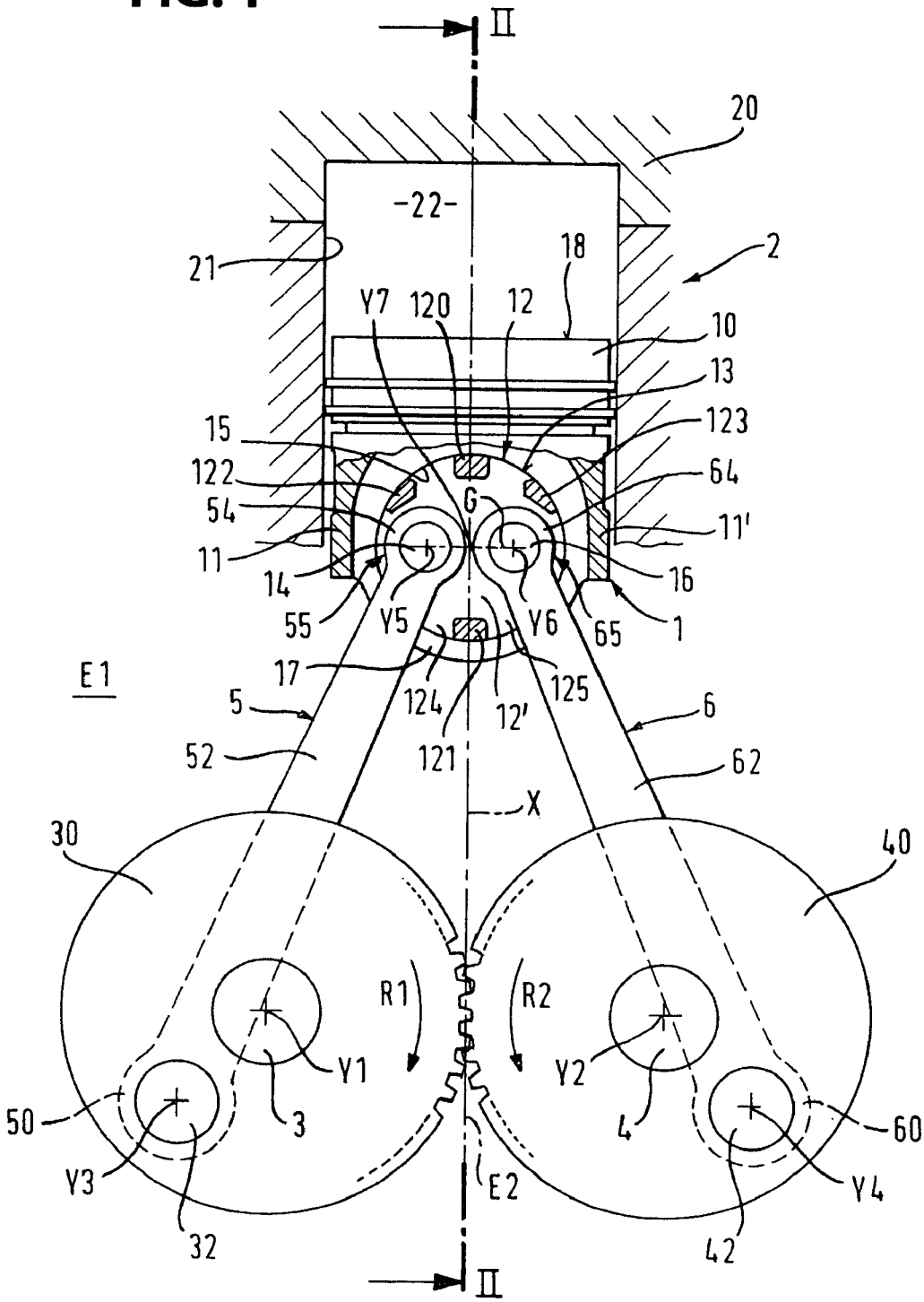
FIG. 1 illustrates a partial sectional view of a twin crankshaft piston engine with a piston according to the invention.

FIG. 1 illustrates a twin crankshaft piston engine according to the present invention with a piston 1 according to the invention which is received in a cylinder 2 provided with a cylinder head 20, so that the piston is moveable in an axial direction along a cylinder axis X which in an ideal case coincides with the piston axis. In the interior of the cylinder 2 a compression cavity 22 is formed which is defined by the cylinder 2 with its cylinder head 20 and a piston base 18 of the piston 1. The piston 1 and the cylinder 2 form a piston-cylinder unit of the twin crankshaft piston engine which can either be configured as a combustion engine or as a compressor. The invention is not limited to a twin crankshaft pistion engine with only one piston-cylinder unit. The engine may also include more than one of said piston-cylinder units. Piston engines of this type are well known in the art, so that general components like e.g. valves or a valve train are not illustrated in the figures in detail.

FIG. 1 furthermore illustrates two crankshafts 3 and 4 of the twin crankshaft piston engine respectively comprising a synchronization gear 30, 40. The rotation axes Y1, Y2 of the two crankshafts 3, 4 extend parallel to a cylinder center plane E2 and are laterally offset with respect to the center plane thus disposed on sides of the cylinder center plane E2 which face away from one another. The synchronization gears 30, 40 are in meshing engagement with one another and simultaneously rotate with the same rotational speed (synchronously) in opposite directions as indicated by the arrows R1 and R2.

Crank pins 32, 42 are configured at the respective crankshafts 3, 4 or at the respective synchronization gears 30, 40, so that they are eccentric to the rotation axis Y1, Y2 of the respective crankshaft 3, 4, wherein the crank pins respectively rotatably support connecting rods 5, 6 with connecting rod eyes 50, 60 configured at the bottom ends of the connecting rods, so that the connecting rods are rotatably supported about lower connecting rods axes Y3, Y4.

Respective connecting rod shafts 52, 62 extend from the connecting rod eyes 50, 60 of the respective connecting rods 5, 6 in upward direction to the piston 1. The respective connecting rods 5, 6 are provided with upper connecting rod eyes 54, 64 at their upper piston side ends, wherein the upper connecting rod eyes are pivotably supported on piston side connecting rod pins 14, 16 about an associated upper connecting rod pivot axis or connecting rod eye axes Y5, Y6 in a pivot plane E1 that is orthogonal to the connecting rod pivot axes.

The upper piston side connecting rod pins 14, 16 thus form pivot bearings 55, 65 for pivotably supporting respective connecting rods 5, 6 at the piston 1.

The upper piston side connecting rod pins 14, 16 are provided in a bearing element 12 pivotably supported in the piston body 10. The pivot axis Y7 of the bearing element 12 extends parallel to the pivot axes Y5 and Y6 of the upper pivot bearings 55, 65 of the connecting rods 5, 6.

The bearing pivot axis Y7 is disposed in the center of a straight line G connecting the connecting rod pivot axes Y5, Y6 with one another in the pivot plane E1 and thus the bearing pivot axis Y7 is disposed equidistant from the two connecting rod pivot axes Y5, Y6.

Figure 2:
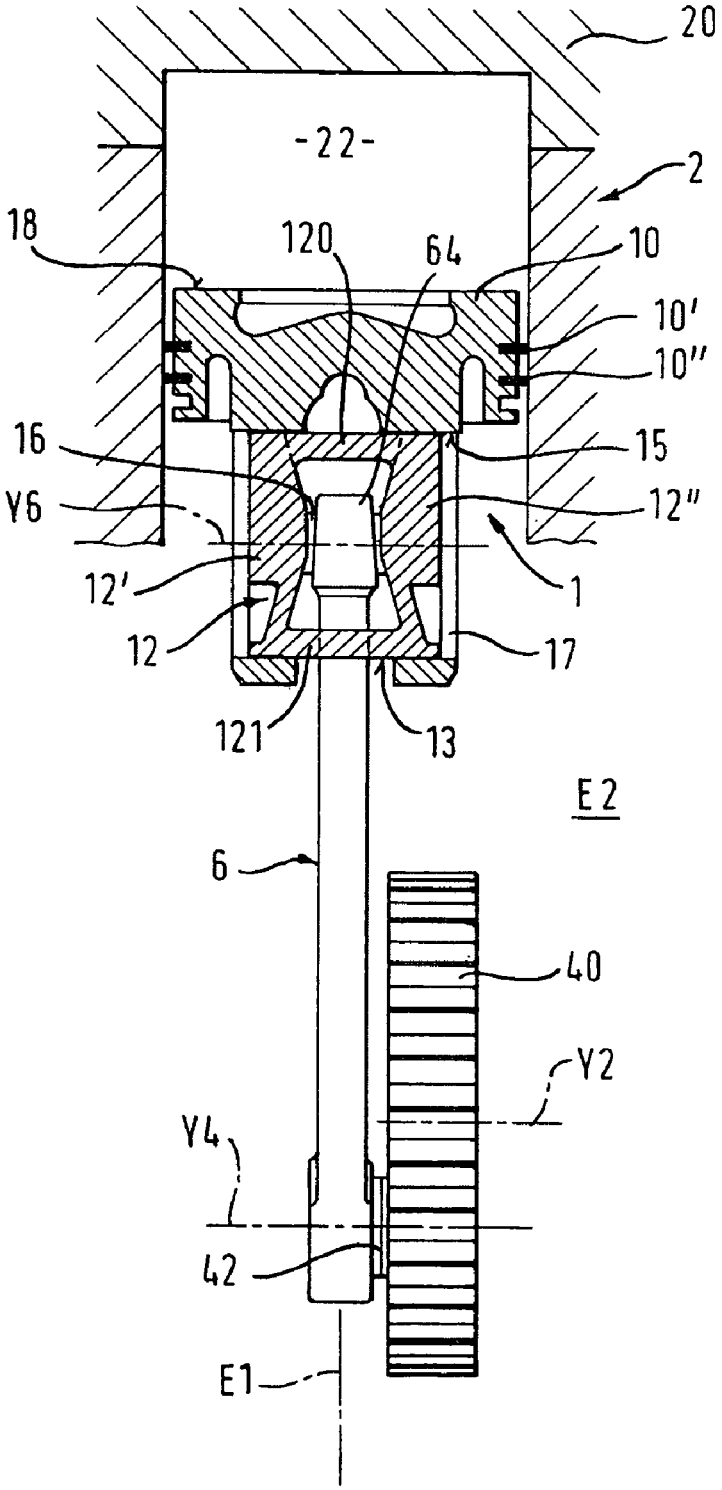
FIG. 2 illustrates a vertical sectional view along the line II-II in FIG. 1

The configuration of the bearing element 12 is subsequently described with reference to FIGS. 1 and 2.

The bearing element 12 has a circular cylindrical outer contour 13 whose circle center is disposed on the axis Y7. With this circular outer contour 13, the cylindrically configured bearing element 12 is rotatably received in an adapted bore hole 15 in a lower portion of the piston 1. The bore hole 15 is configured in a lower bar section 17 of the piston 1 wherein the lower bar section is oriented towards the crank drive. The bar section 17 is disposed on the side of the piston 1 facing away from the piston base 18.

The bearing element 12 includes two face wall sections 12', 12" oriented away from one another, wherein the wall sections are offset from one another in the direction of the pivot axis Y6 of the bearing element 12 and form a gap where the respective connecting rods 5, 6 engage with their piston side end sections. The piston side connecting rod pins 14, 16 extend between the two wall sections 12', 12" of the bearing element 12.

In the portion of the circumference of the support element 12 the wall sections 12', 12" are connected through an upper bar 120, a lower bar 121 and lateral circumferential wall sections 122, 123. Along the circumference pass through openings 124, 125 for the respective connecting rod shafts 52, 62 of the connecting rods 5, 6 are configured between the lower bar 121 and the respective circumferential wall sections 122, 123. The extension of the pass through openings 124, 125 in circumferential direction of the support element 12 is sized, so that the connecting rods 5, 6 are neither restricted by the lower center bar 121, nor by the lateral circumferential wall sections 122, 123 with respect to the pivot movements of the connecting rods about the axes Y5 and Y6.

The piston 1 is provided in a conventional manner with piston rings 10', 10" whose configuration and function is not described in more detail herein, since they are generally known in the art. The piston 1 furthermore includes piston skirt sections 11, 11' in the lower portion of the piston, wherein the piston skirt sections can be in sliding friction with the bore of the cylinder 2 and can this way support the piston 1 with respect to a possible tilt movement transversal to the piston axis and cylinder axis X at the cylinder inner wall 21.

Figure 3:
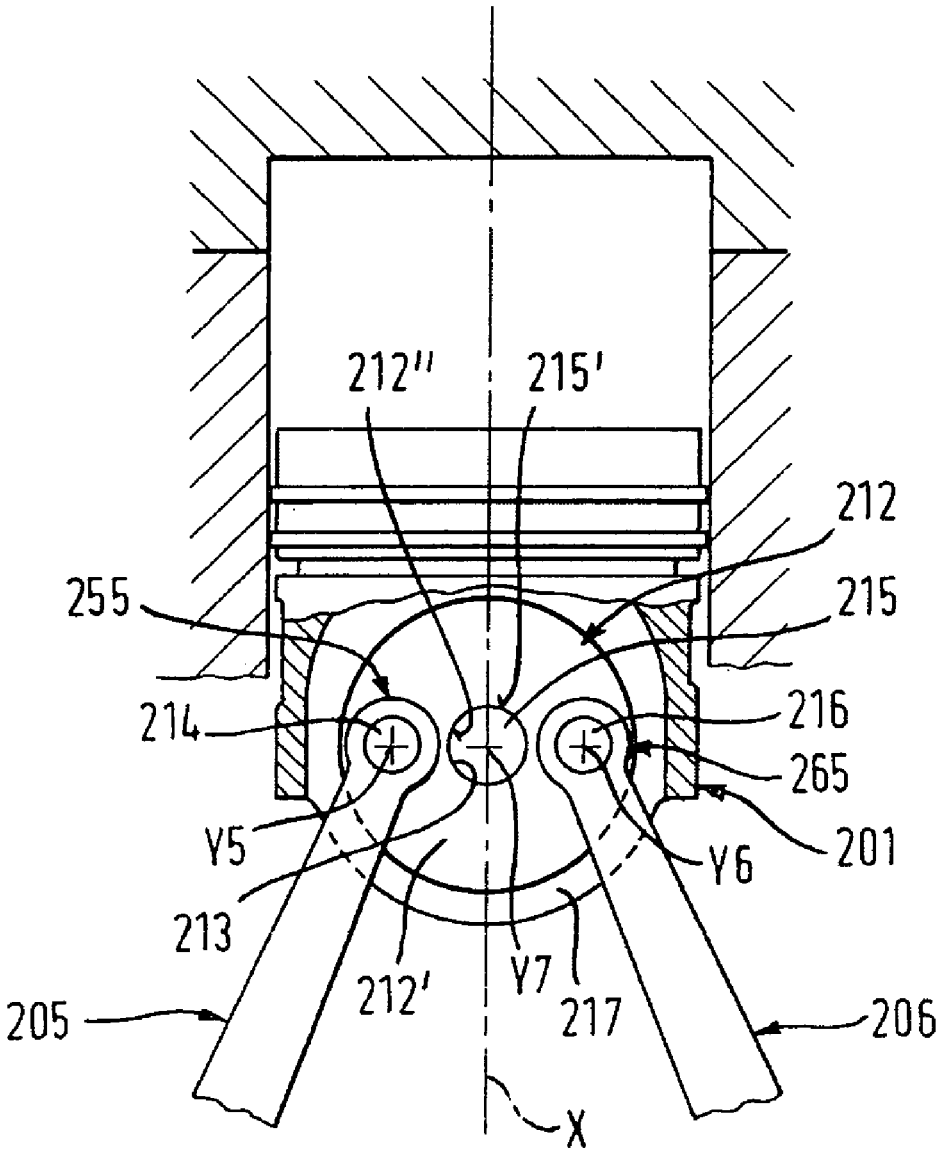
FIG. 3 illustrates a partial sectional frontal view of a second embodiment of a piston according to the invention.

FIG. 3 illustrates a modified embodiment of the piston and of the piston engine in which the bearing element 212 is configured as an annular disc and provided with a bore hole 213 which is concentric with the axis Y7. The lower bar section 217 of the piston 201 is provided with a cylindrical bearing pin 215 whose axis extends coaxial with the axis Y7 and wherein the inner circumference 212" of the annular disc body 212' of the bearing element 212 is rotatably supported on the radially outer circumference 215' of the bearing pin 215.

The upper pivot bearings 255, 265 of the connecting rods 205, 206 are configured with connecting rod bearing pins 214, 216 provided at the bearing element 212 like in the first embodiment, wherein the connecting rod bearing pins are disposed with respect to the piston and cylinder axis X on both sides of the central bore hole 213 of the bearing element 212 and extend with their respective axes Y5, Y6 parallel to the axis Y7.

Figure 4:
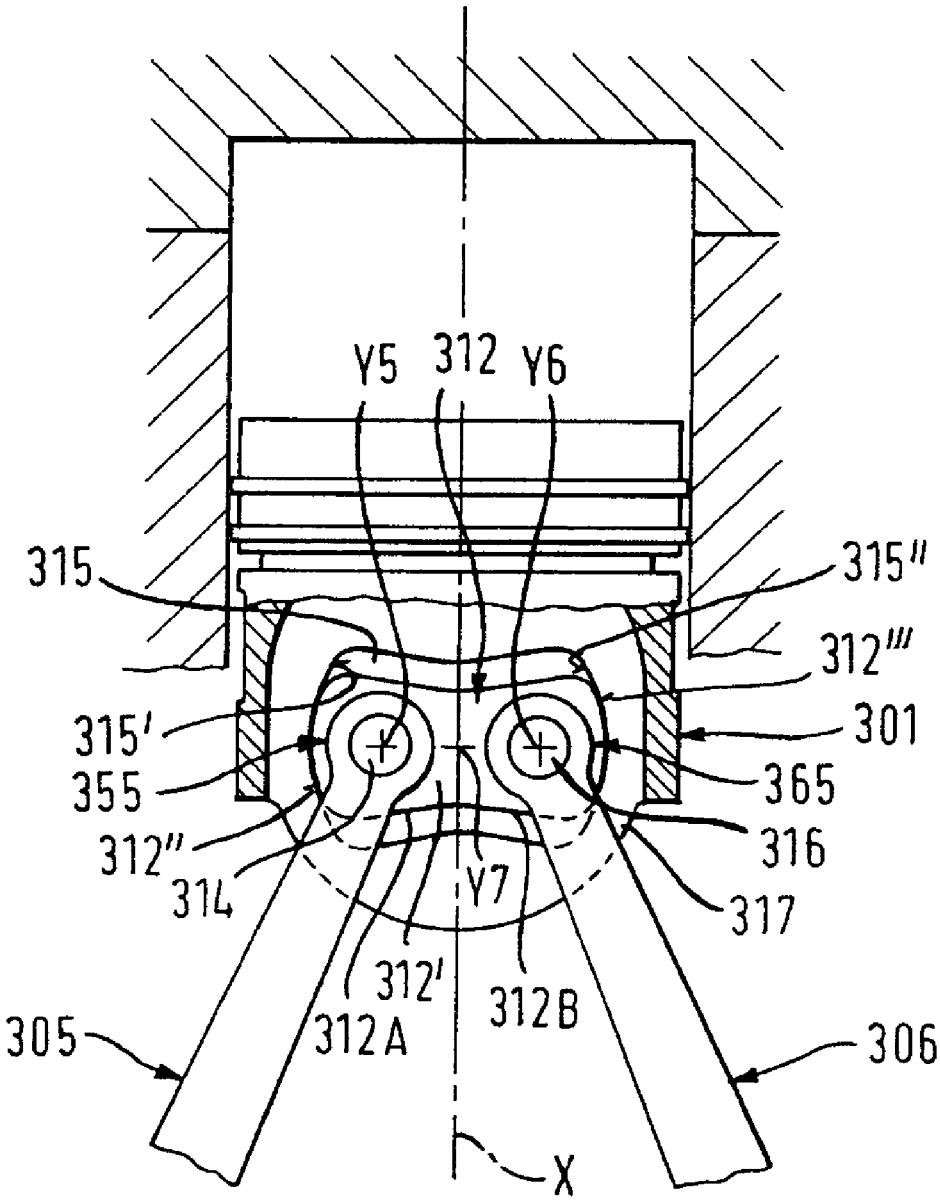
FIG. 4 illustrates a partial sectional frontal view of a third embodiment of a piston according to the invention.

FIG. 4 illustrates another embodiment of the piston according to the invention and of the piston engine according to the invention, wherein the bearing element 312 has the shape of two circular segment portions 312A, 312B which contact one another in the portion of the piston and cylinder axis X and which are connected with one another. The bearing element 312 thus has a bone shaped body 312' with circular cylinder shaped surface sections 312", 312'" configured at the lateral outsides of the body, wherein the curvature radius of the surface sections is disposed on the pivot axis Y7 of the bearing element 312.

The lower bar section 317 of the piston 301 is like in the embodiment in FIG. 1 configured with a pass through opening 315 which extends in the direction of the axis Y7. The pass through opening 315 includes two lateral inner surfaces 315', 315" cambered like circular cylinder segments whose curvature radius is disposed on the axis Y7, so that the curvature of the lateral surfaces 315', 315" corresponds to the curvature of the circular cylinder segment shaped surface sections 312", 312'" of the bearing element 312. The length of the cambered inner surfaces 315', 315" in camber direction is greater than the length of the cambered surface sections 312", 312'" of the bearing element 312 and also the vertical dimensions in the direction of the X axis of the pass through opening 315 are greater than the vertical dimensions of the bearing element 312, so that sufficient space is provided above and below the bearing element 312 inserted into the pass through opening 315, so that the bearing element 312 can perform a pendulum pivot movement about the axis Y7 in the pass through opening 315.

The upper pivot bearings 355, 365 of the connecting rods 305, 306 are configured with connecting rod bearing pins 314, 316 configured on the bearing element 312 like in the first embodiment, wherein the connecting rod bearing pins are disposed on both sides of the axis Y7 with respect to the piston and cylinder longitudinal axis X and their axes Y5, Y6 extend parallel to the axis Y7.

The function of the piston drive of the piston engine with the piston according to the invention is subsequently described with reference to FIG. 5. The piston drive illustrated in FIG. 5 corresponds with respect to its configuration to the piston drive of FIG. 1, so that the same reference numerals are being used as in FIG. 1.

Figure 5:
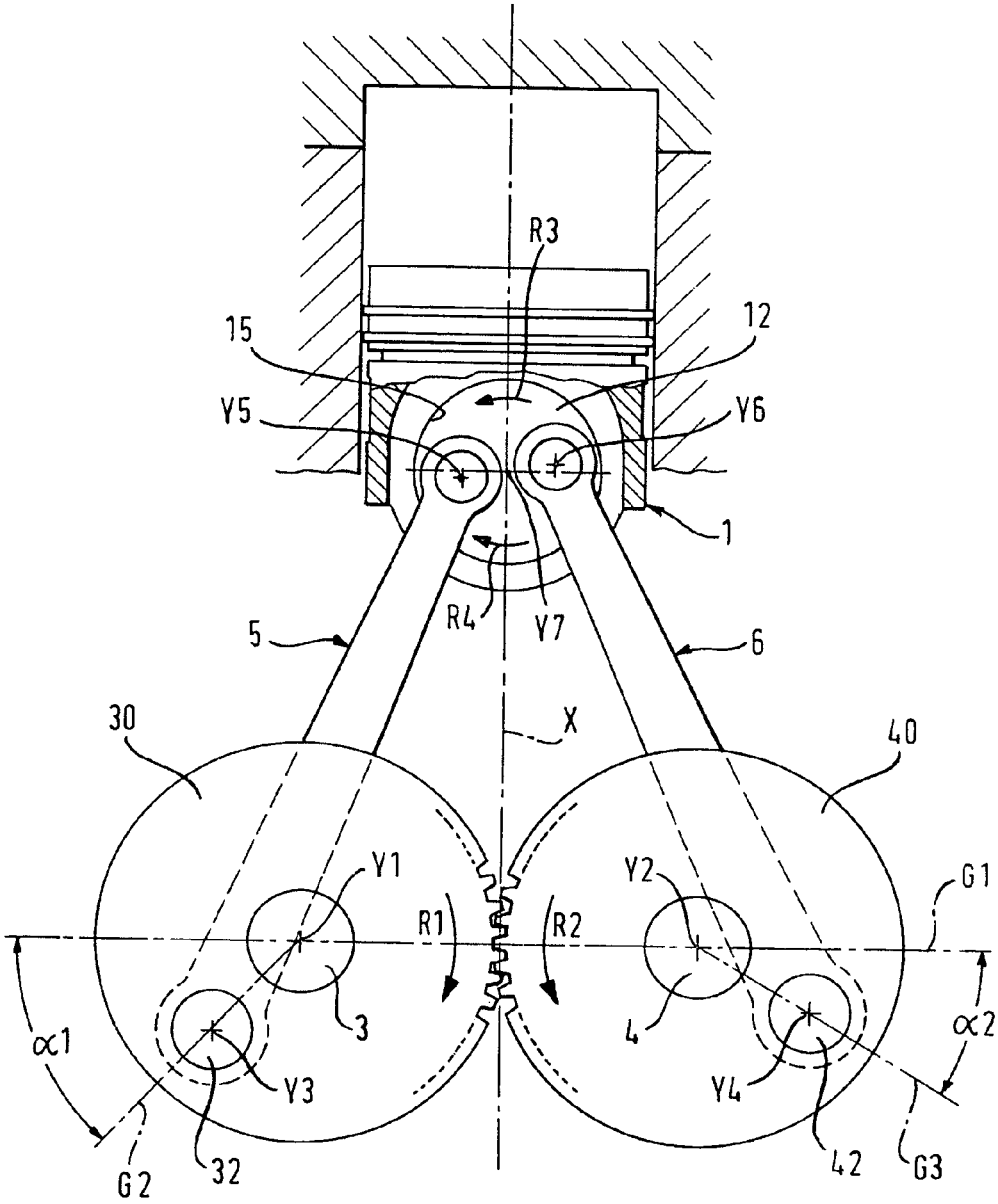
FIG. 5 illustrates a twin crankshaft piston engine according to the invention with a crank drive running in a slightly asynchronous manner

It is apparent from the illustration in FIG. 5 that the angle $\alpha 1$ between a straight line G1 connecting the two crankshaft axes Y1 and Y2 and a straight line G2 connecting the crankshaft axis Y1 and the lower connecting rod bearing axis Y3 of the first connecting rod 5 is greater than the respective angle $\alpha 2$ between the straight line G1 and the straight line G3 connecting the crankshaft axis Y2 of the second crankshaft 4 with the lower connecting rod bearing axis Y4 of the second connecting rod 6. This provides an asymmetry between the left crank drive with the crankshaft 3 and the connecting rod 5 and the right crank drive with the crankshaft 4 and the connecting rod 6. This asymmetry can be caused e.g. by wear at the tooth flanks of the synchronization gears 30, 40 meshing with one another.

Though the two crankshafts 3, 4 rotate with the same speed of rotation in opposite directions R1 and R2 and thus are synchronized time based, the asymmetry causes a precession of the crankshaft 4 and of the connecting rod 6 with respect to the crankshaft 3 with the connecting rod 5. This precession causes a pivoting of the bearing element 12 about its rotation axis Y7 in the direction of rotation of the preceding crankshaft 4 during the upward movement of the crankshaft side connecting rod bearing pin 42, thus in the illustrated embodiment counterclockwise as illustrated by the arrow R3. For a downward movement of the crankshaft side connecting rod pin 42 of the second preceding crankshaft 4, the direction of rotation of the bearing element 12 is reversed, so that the bearing element 12 is now pivoted clockwise according to arrow R4. This way the bearing element 12 performs a pendulum type tilt movement in the bore hole 15 of the piston 1 without the piston 1 tilting with respect to the longitudinal axis X.

Also in the embodiments of FIGS. 3 and 4 the respective bearing element 212, 312 perform perspective pendulum type pivot movements in the same manner.

When the two synchronization gears 30, 40 meshing with one another are exactly aligned with one another and when there is no wear in the portion of the teeth of these synchronization gears 30, 40 meshing with one another, the angles $\alpha 1$ and $\alpha 2$ are identical with one another in the simplest embodiment of the present invention as illustrated in FIG. 1. In this embodiment there is no pendulum movement of the bearing element 12 in the bore hole 15 of the piston 1 until a wear that has occurred between the teeth of the synchronization gears 30, 40 causes the asymmetry of the rotation of the crankshafts 3, 4 described supra. However, when the bearing element 12 does not move relative to the piston 1, thus when no pendulum type pivot occurs, the bearing pressure can cause a deformation of the bearing surfaces between the outer circumferential surface of the bearing element 12 and the inner circumferential surface of the bore hole 15 which restricts the relative pivotability of the bearing element 12 with respect to the piston 1 or prevents it completely.

In order to prevent a deformation of this type of the bearing surfaces between the support element 12 and the piston 1, a slight asymmetry to the angles $\alpha 1$ and $\alpha 2$ not being equal as illustrated in FIG. 5 can also be provided in a new condition of the piston engine, thus when no wear has occurred between the synchronization gears 30, 40. Thus, the bearing element 12 continuously, thus also when it is new, performs a pendulum type pivot movement in the bore hole 15 of the piston 1 which prevents a bearing compression and thus a deformation associated therewith. When wear occurs in the portion of the teeth of the synchronization gears 30, 40 meshing with one another, the original pendulum type pivot movement of the bearing element increases. Thus, the piston 1 is not subjected to a tilt movement induced by the crank drive at any point in time.

Thus, it is seen that the objects of the present invention are efficiently obtained although modifications and changes to the invention should be readily apparent to those having ordinary skill in the art, which modifications are intended to be within the spirit and scope of the invention as claimed. It also is understood that the foregoing description is illustrative of the present invention and should be considered as limiting. Therefore, other embodiments of the invention are possible without departing from the spirit and scope of the present invention. In particular the device can have features which are combined from the respective features of the patent claims. Reference numerals in the description and the drawing figure are only intended to facilitate the understanding of the invention and do not limit its scope.

Reference Numerals and Designations

1 piston
2 cylinder
3 crankshaft
4 crankshaft
5 connecting rod
6 connecting rod
10 piston body
10' piston ring
10" piston ring
11 piston skirt section
11' piston skirt section
12 bearing element
12' face side wall section
12" face side wall section
13 circular outer contour
14 piston side connecting rod bearing pin
15 bore hole
16 piston side connecting rod bearing pin
17 lower bar section
18 piston base
19 cylinder head
21 cylinder inner wall
22 compression cavity
30 synchronization gear
32 bearing pin
40 synchronization gear
42 bearing pin
50 lower connecting rod eye
52 connecting rod shaft
54 upper connecting rod eye
55 pivot bearing
60 lower connecting rod eye
62 connecting rod shaft
64 upper connecting rod eye
65 pivot bearing
120 upper bar
121 lower bar
122 lateral circumferential wall section
123 lateral circumferential wall section
124 pass through opening
125 pass through opening
201 piston
205 connecting rod

206 connecting rod
212 bearing element
212' annular disc body
212" inner circumference
213 concentric bore hole
214 piston side connecting rod bearing pin
215 cylindrical bearing pin
215' circular outer circumference
216' piston side connecting rod bearing pin
217 lower bar section
255 upper pivot bearing
265 upper pivot bearing
305 connecting rod
306 connecting rod
312 bearing element
312' body
312" circular cylindrical surface section
312'" circular cylindrical surface section
312A circular segment section
312B circular segment section
314 connecting rod bearing pin
315' lateral surface
315" lateral surface
316 piston rod bearing pin
355 upper pivot bearing
365 upper pivot bearing
E1 pivot plane
E2 cylinder center plane
G straight line
X piston and cylinder axis
Y1 rotation axis
Y2 rotation axis
Y3 lower connecting rod eye axis
Y4 lower connecting rod eye axis
Y5 upper connecting rod eye axis
Y6 upper connecting rod eye axis
Y7 bearing element pivot axis

What is claimed is:

1. A piston comprising:

two pivot bearings for pivotably supporting two connecting rods at a piston about two connecting rod pivot axes;

the two connecting rod pivot axes extending in parallel to one another and laterally offset from one another;

the two pivot bearings provided at a bearing element which is pivotably supported about a bearing element pivot axis at the piston; and the bearing element pivot axis extending parallel to the two connecting rod pivot axes.

2. The piston according to claim 1, wherein the bearing element pivot axis is offset respectively equidistant from the two connecting rod pivot axes, and wherein the offset is measured in a pivot plane orthogonal to the bearing pivot axis.

3. The piston according to claim 2, wherein the bearing element pivot axis is disposed in the center of a straight line connecting the two connecting rod pivot axes in the pivot plane with one another.

4. The piston according to claim 1, wherein the bearing element includes a circular contour with a circle center disposed on the bearing element pivot axis, wherein the piston includes a circular contour with a circle center disposed on the bearing element pivot axis, and wherein the circular contour of the bearing element and the circular contour of the piston are disposed, so that they contact one another and are moveable relative to one another about the common bearing element pivot axis.

5. The piston according to claim 4, wherein the bearing element is configured as a disc or as a ring and the circular contour is configured at an outer circumferential edge of the bearing element.

6. The piston according to claim 4, wherein the bearing element is configured as a ring and the circular contour is configured at an inner circumferential edge of the bearing element.

7. The piston according to claim 1, wherein the bearing element includes at least one circular segment shaped contour with a circle center of the circular segment shaped contour disposed on the bearing element pivot axis, wherein the piston includes at least one circular segment shaped contour with a circle center of the circular segment shaped contour disposed on the bearing element pivot axis, and wherein the at least one circular segment shaped contour of the bearing element and the at least circular segment shaped contour of the piston are disposed, so that they contact one another and are moveable relative to one another about the common bearing element pivot axis.

8. The piston according to claim 7, wherein the bearing element is configured as a disc or as a ring and the at least one circular segment shaped contour is configured at an outer circumferential edge of the bearing element.

9. The piston according to claim 7, wherein the bearing element is configured as a ring and the at least one circular segment shaped contour is configured at an inner circumferential edge of the bearing element.

10. A twin crankshaft piston engine with at least one piston cylinder unit, comprising:

a cylinder in which a reciprocating piston is disposed, so that it can move back and forth;

a first crankshaft;

and a second crankshaft, wherein the first crankshaft and the second crankshaft extend parallel to one another and rotate synchronously in opposite directions, wherein the rotation axes of the two crankshafts extend parallel to a common cylinder center plane and are laterally offset with respect to the cylinder center plane, wherein a first and a second connecting rod is associated with the reciprocating piston, so that the first connecting rod is pivotably supported with its first end at the reciprocating piston in a first pivot bearing about a first connecting rod pivot axis and rotatably supported with its second end at a crank pin of the first crankshaft, wherein the second connecting rod is pivotably supported with its first end at the reciprocating piston in a second pivot bearing about a second connecting rod pivot axis and rotatably supported with its second end at a crank pin of the second crankshaft, and wherein the first and the second pivot bearing are provided at a bearing element which is pivotably supported at the piston about a bearing element pivot axis which extends parallel to the connecting rod pivot axes.

11. The twin crankshaft piston engine according to claim 10, wherein the bearing pivot axis is respectively offset equidistant from the connecting rod pivot axes in a pivot plane orthogonal to the bearing element pivot axis.

12. The twin crankshaft piston engine according to claim 11, wherein the bearing element pivot axis is disposed in the center of a straight line connecting the connecting rod pivot axes in the pivot plane with one another.

13. The twin crankshaft piston engine according to claim 10, wherein the bearing element includes a circular contour whose circle center is disposed on the bearing element pivot axis, wherein the piston includes a circular contour whose circle center is also disposed on the bearing element pivot axis, and wherein the circular contour of the bearing element and the circular contour of the piston contact one another but are disposed moveable relative to one another about the bearing element pivot axis.

14. The twin crankshaft piston engine according to claim 13, wherein the bearing element is configured as a ring and the circular contour is configured at an outer circumferential edge of the bearing element.

15. The twin crankshaft piston engine according to claim 13, wherein the bearing element is configured as a ring and the circular contour is configured at an inner circumferential edge of the bearing element.

16. The twin crankshaft piston engine according to claim 10, wherein the bearing element Includes at least one circular segment shaped contour whose circle center is disposed on the bearing element pivot axis, wherein the piston includes at least one circular segment shaped contour whose circle center is also disposed on the bearing element pivot axis, and wherein the at least one circular segment shaped contour of the bearing element and the at least one circular segment shaped contour of the piston contact one another but are disposed moveable relative to one another about the bearing element pivot axis.

17. The twin crankshaft piston engine according to claim 16, wherein the bearing element is configured as a ring and the at least one circular segment shaped contour Is configured at an outer circumferential edge of the bearing element.

18. The twin crankshaft piston engine according to claim 16, wherein the bearing element is configured as a ring and the at least one circular segment shaped contour is configured at an inner circumferential edge of the bearing element.

19. The twin crankshaft piston engine according to claim 10, wherein an assembly including the two crankshafts rotating synchronously in opposite directions is configured, so that the crank pins rotate in opposite directions, but with a slight asymmetry.

20. The twin crankshaft piston engine according to claim 19, wherein the asymmetry of the rotation of the crank pins is 5° at the most.

21. The twin crankshaft piston engine according to claim 19, wherein the asymmetry of the rotation of the crank pins is based on an offset of 1 to 6 teeth between meshing gears respectively disposed on the first crankshaft and on the second crankshaft.

* * * * *